US005434471A

United States Patent [19]

Jeong

[11] Patent Number: 5,434,471

[45] Date of Patent: Jul. 18, 1995

[54] ELECTRON GUN HAVING FOCUSING ELECTRODE AND ANODE WITH A PLURALITY OF STRAIGHT LINE SEGMENTS

[75] Inventor: Bong K. Jeong, Daegu, Rep. of Korea

[73] Assignee: Goldstar Co., Ltd., Seoul, Rep. of Korea

[21] Appl. No.: 266,663

[22] Filed: Jun. 28, 1994

Related U.S. Application Data

[63] Continuation of Ser. No. 933,223, Aug. 21, 1992, abandoned.

[30] Foreign Application Priority Data

Aug. 22, 1991 [KR] Rep. of Korea ..... 13335/1991

[51] Int. Cl.[6] ..... H01J 29/56

[52] U.S. Cl. ..... 313/414; 313/415

[58] Field of Search ..... 313/409, 414, 415, 412, 313/413

[56] References Cited

U.S. PATENT DOCUMENTS

| | | | |
|---|---|---|---|
| 4,581,560 | 4/1986 | Shirai et al. | 313/414 |
| 4,742,279 | 5/1988 | Gerritsen et al. . | |
| 4,766,344 | 8/1988 | Say | 313/414 |
| 5,142,189 | 8/1992 | Sugahara et al. | 313/414 |
| 5,146,133 | 9/1992 | Shirai et al. | 313/414 |
| 5,212,423 | 5/1993 | Noguchi et al. | 313/414 |

FOREIGN PATENT DOCUMENTS 152933 2/1985 European Pat. Off. .

*Primary Examiner*—Donald J. Yusko
*Assistant Examiner*—N. D. Patel

[57] ABSTRACT

An electron gun for a color picture tube having heaters, cathodes, a control electrode, a screen electrode, a focusing electrode and a anode, the focusing electrode for forming a main lens and said anode further having elongated octagonally shaped apertures. The electron gun thus configured enables the convergence and resolution of the color picture tube to be improved.

1 Claim, 4 Drawing Sheets

ELECTRON GUN HAVING FOCUSING ELECTRODE AND ANODE WITH A PLURALITY OF STRAIGHT LINE SEGMENTS

This application is a continuation of application Ser. No. 07/933,233, filed on Aug. 21, 1992, now abandoned.

BACKGROUND OF THE INVENTION

1. Field of the Invention

The present invention relates to an electron gun for a color picture tube, more particularly to an electron gun for a color picture tube in which the shapes of the apertures in the electrodes forming a main focusing lens and anode are modified to improve a focusing and a resolution of the picture on a screen.

2. Description of the Prior Art

Referring to FIG. 1, there is shown a conventional color picture tube. The color picture tube is typically glass bulb comprising a panel 11 to which a phosphor film 12 is applied and a funnel 13. The color picture tube has an electron gun 8 for inwardly directly emitting thermions to the inside and a shadow mask 14 for selecting colors therein. A deflection yoke 15 which causes electron beams to be deflected is mounted around a neck of the funnel 13.

Referring now to FIG. 2, there is shown a conventional electron gun. Although there are many kinds of electron guns which have an important effect on a picture of a screen, there is illustrated one type of conventional electron gun.

The electron gun 8 includes three heaters 10 and cathodes 9, a control electrode 4 and a screen electrode 5 positioned in front of the cathodes 9, and a focusing electrode 3, an anode 6 and a shield cup 7 positioned in front of the screen electrode 5, all of which are disposed at given intervals. The focusing electrode 3 has an electrode body 1 and a cap 2.

In the electron gun 8 shown in FIG. 2, the cathodes 9 emit electron beams by heating of the heater 10. Upon passing through the electrodes, the electron beams are focused and then impinge on the phosphor film 12 applied to the screen, thereby permitting an image to appear on the screen as shown in FIG. 1.

In this embodiment, the electron gun 8 is formed with two electrostatic lenses, as shown in FIG. 2. One of the electrostatic lenses is a pre-focusing lens formed by a potential difference between the screen electrode 5 and the focusing electrode 3 and the other electrostatic lens is a main focusing lens formed by a potential difference between the focusing electrode 3 and the anode 6. The former functions to suppress dispersion of electron beams, whereas the latter functions to focus electron beams on the screen.

Accordingly, in order to obtain well defined beam spots of electron beams on the screen, there have been proposed configurations wherein the number of the lenses formed in the electron gun is changed, structures of the electrodes are changed, or structures of beam-passing apertures are modified.

Referring now to FIG. 3, there is shown prior art beam-passing apertures of the focusing electrode 3 and the anode 6. When the apertures 3*a* and 6*a* of the focusing electrode 3 and the anode 6 have regular circular shapes as shown in the drawing, the diameters are relative small so that larger diameter lenses can not be formed and a phenomenon occurs so that shapes of electron beam spots become compressed by spherical aberration as they progress toward the circumferential edge of screen as shown in FIG. 4, and a high resolution can not, be obtained. The phenomenon mentioned above causes the quality of a picture tube to be deteriorated.

Also, another attempt, for eliminating the drawbacks mentioned above is disclosed in U.S. Pat. No. 4,742,279. In this patent, an additional auxiliary focusing lens is formed in a focusing electrode and apertures in the auxiliary focusing lens have rectangular shapes. The auxiliary focusing lens does not form a main lens, but, act as a dynamic electrode to prevent a deterioration of circumferential beam. However, the auxiliary focusing lens causes the number of electrodes to be increased.

Also, a further attempt, is described in E.P.O. Publication No. 0 152 933 B1. As described in the publication, a multiple focusing electron gun is disclosed in which ovular beam-passing apertures having burring portions for slightly changing paths of electron beams generated by a third electrode, are provided to form an auxiliary focusing lens. However, the electron gun also causes the number of electrodes to be increased and is difficult to manufacture due to its intricate structure.

SUMMARY OF THE INVENTION

Therefore, the present invention has been made in view of the above-described prior art problems and an object of the invention is to provide an electron gun for a color picture tube in which the size of the beam-passing apertures of the electrode for forming a main lens are increased in order to prevent beam spots at a circumferential edge of the screen from being deformed.

In accordance with the present invention, the object mentioned above can be accomplished by providing an electron gun for a color picture tube comprising heaters, cathodes, a control electrode, a screen electrode, a focusing electrode and an anode, characterized in that: said focusing electrode for forming a main lens and said anode have longitudinal octagonal shaped-beam-passing apertures.

BRIEF DESCRIPTION OF THE DRAWINGS

These and other objects, features and advantages of the invention will become more apparent upon a reading of the following detailed specification and drawings, in which.

DETAILED DESCRIPTION OF THE PREFERRED EMBODIMENTS

Figure 1:
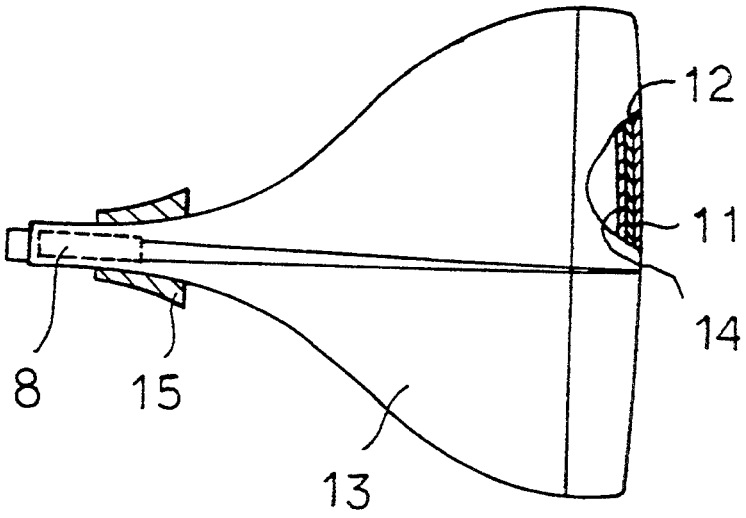
FIG. 1 PRIOR ART
FIG. 1 is a side elevation view generally illustrative of a color picture tube.
Figure 2:
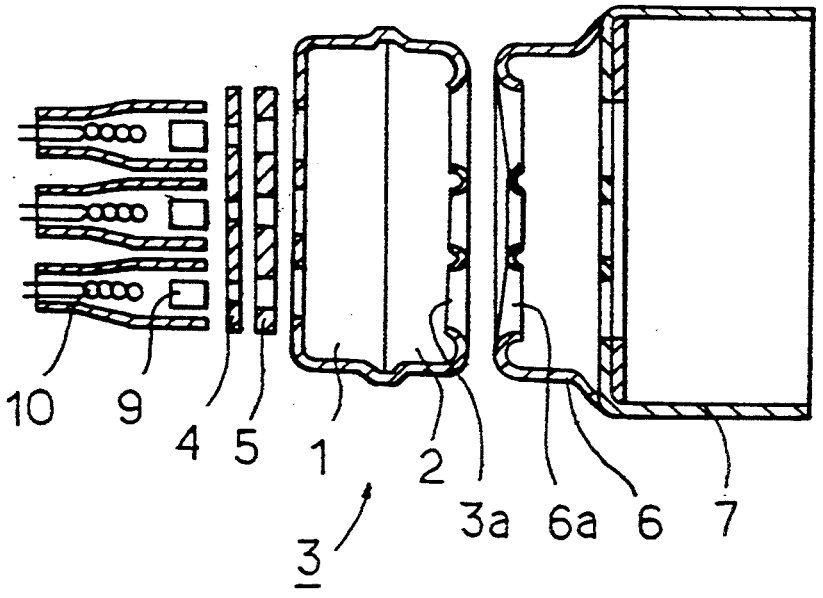
FIG. 2 PRIOR ART
FIG. 2 is on central cross sectional view of a conventional electron gun.
Figure 3:
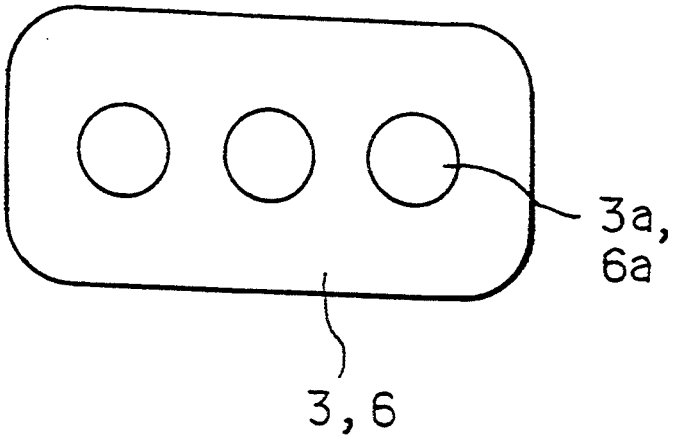
FIG.3 PRIOR ART
FIG. 3 is a front view of conventional electrode for forming a main lens.
Figure 4:
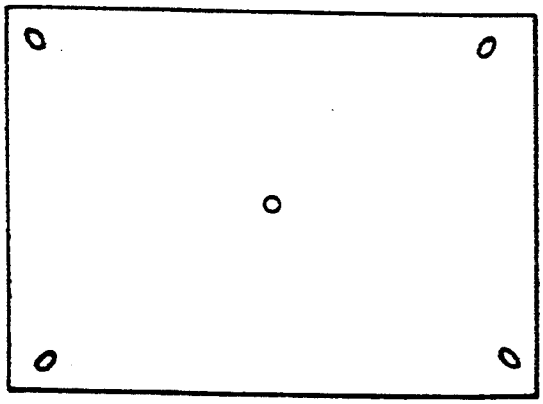
FIG.4 PRIOR ART
FIG. 4 illustrates beam spots appearing on a screen by a conventional electrode.
Figure 5:
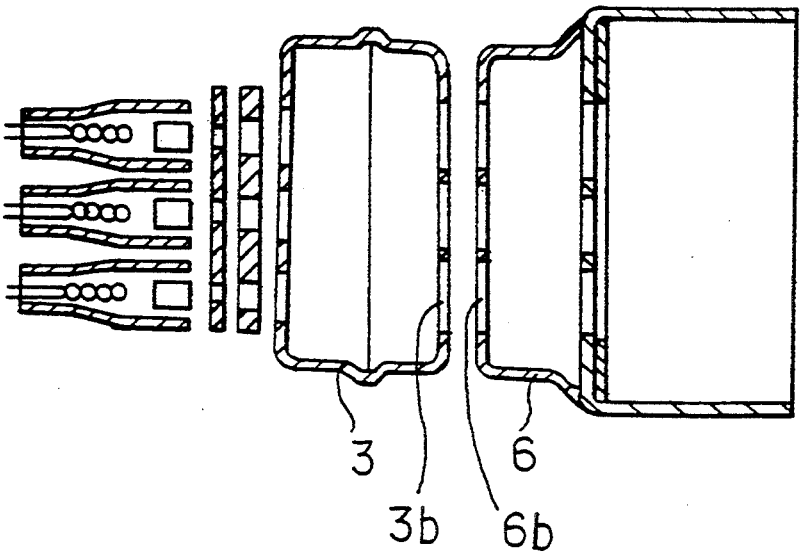
FIG. 5 is a central cross sectional view of an electron gun according to the present invention.

Referring now to FIG. 5, there is shown an electron gun according to the invention. Where structures of parts of an electron gun according to the invention and shown in the drawing are substantially like those of a conventional electron gun shown in FIG. 2, the substantially identical or similar elements to those of the electron illustrated in FIG. 2 are designated by the same reference characters and needs no further explanation.

Figure 6:
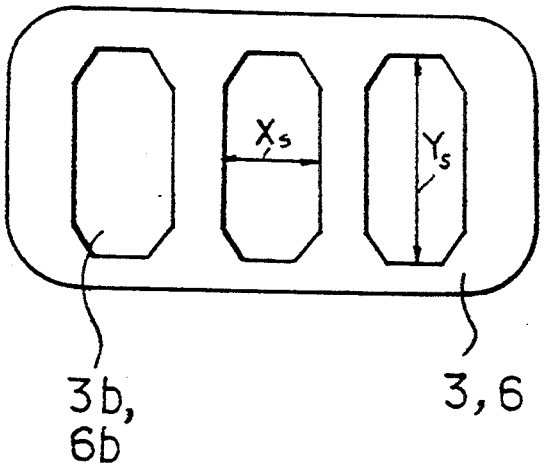
FIG. 6 is a front view of an electrode for forming a main lens.

Referring to FIG. 6, there is shown a focusing electrode 3 or an anode 6 which functions to focus electron beams so as to form a main lens. Beam-passing apertures 3*b* of the focusing electrode 3 and apertures 6*b* of the anode facing the apertures 3*b* are comprised of enlarged longitudinal octagonal shapes each of which has a longitudinal or major axis length (Ys) longer than a mutually orthogonal or minor axis length (Xs).

As mentioned above, apertures 3*b* of the focusing electrode 3 and apertures 6*b* of the anode facing apertures 3*b* have enlarged longitudinal octagonal shapes so that a lens formed by the apertures 3*b* and 6*b* is larger than those formed by known prior art beam-defining apertures, thereby enabling spherical aberration to be reduced.

Figure 7:
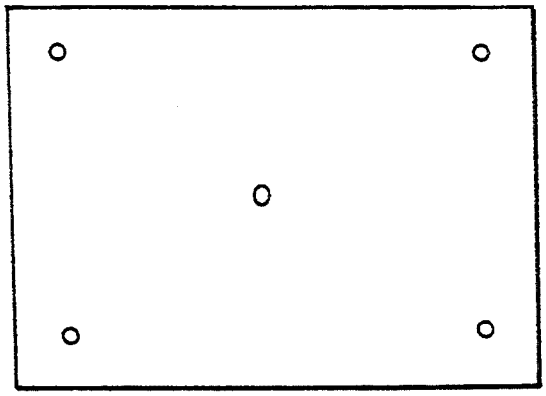
FIG. 7 illustrates beam spots appearing on a screen by an electrode according to the invention.

Accordingly, as illustrated in FIG. 7, since beam spots appearing on a central portion of screen have elongated circular or ovular shapes, deformation of these beam spots appearing on a circumferential edge, of screen by a spherical aberration can be substantially reduced, thereby improving the quality of picture tube by virtue of high resolution.

While the beam-defining apertures having longitudinal octagonal shapes as a preferred from of the present invention has been described in this embodiment, it is to be understood that various modifications of the apertures, for example, longitudinal circle shapes or substantial tetragonal shapes will be apparent to those skilled in the art without departing from the scope of the invention as defined by the appended claims.

As described hereinbefore, the electron gun according to the invention has a simple structure of electrodes so that the beam-defining apertures of the electrodes can be easily machined. Furthermore, it is possible to obtain improved convergence and resolution and reduce manufacturing cost.

What is claimed is:

1. An electron gun for a color picture tube having heaters, cathodes, a control electrode, a screen electrode, a focusing electrode and an anode, comprising:

a focusing electrode for forming a main lens and an anode, each having a set of elongated mutually parallel octagonally shaped beam-passing apertures each of which includes a longitudinal or major axis having a length Ys and a mutually orthogonal or minor axis having a length Xs, where Ys is greater than Xs, and each of the apertures further comprising straight line segments intersecting each other and having an inside angle greater than 90°, thus making it possible to expand the length Xs of said apertures along the minor axis and form relatively larger apertures in a defined magnitude of said color picture tube and enabling correction of astigmatism and spherical aberration while preventing deflection deformation of an electron beam at the circumferential edge of a picture tube screen, thereby substantially improving the resolution of an image formed thereat.

* * * * *